US007976119B2

(12) United States Patent
Aoki et al.

(10) Patent No.: US 7,976,119 B2
(45) Date of Patent: Jul. 12, 2011

(54) PRINTING APPARATUS

(75) Inventors: Yuji Aoki, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 376 days.

(21) Appl. No.: 12/388,059

(22) Filed: Feb. 18, 2009

(65) Prior Publication Data

US 2009/0213159 A1 Aug. 27, 2009

(30) Foreign Application Priority Data

Feb. 21, 2008 (JP) ..... 2008-039670

(51) Int. Cl.
*B41J 2/165* (2006.01)
*B41J 2/175* (2006.01)

(52) U.S. Cl. ..... 347/23; 347/86

(58) Field of Classification Search ..... 347/7, 22, 347/23, 85, 86
See application file for complete search history.

(56) References Cited

U.S. PATENT DOCUMENTS 5,850,237 A * 12/1998 Slade ..... 347/23
6,488,354 B2 * 12/2002 Hosono ..... 347/23

FOREIGN PATENT DOCUMENTS

| | | |
|---|---|---|
| JP | 11-005300 | 1/1999 |
| JP | 2000-153622 | 6/2000 |
| JP | 2000-296627 | 10/2000 |
| JP | 2005-104089 | 4/2005 |

* cited by examiner

*Primary Examiner* — An H Do

(57) ABSTRACT

A printing apparatus includes a recording head that prints an image and an ink cartridge that stores ink to the recording head. The ink cartridge includes an ink pack and an ink-end sensor that detects an ink-end point based on the pressure of ink supplied from the ink pack. The ink pressure corresponding to the ink-end point detected by the ink-end sensor is set to a first pressure that is the minimum pressure near an outlet of the ink cartridge at which the recording head can print an image of predetermined quality. A determining unit permits starting of a printing or cleaning operation in response to a command issued before the ink-end sensor detects the ink-end point and prohibits starting of a printing or cleaning operation in response to a command issued after the ink-end sensor has detected the ink-end point.

6 Claims, 11 Drawing Sheets

PRINTING APPARATUS

BACKGROUND

1. Technical Field

The present invention relates to printing apparatuses suitable for use as, for example, printers, and particularly to improvements in determination of whether or not a cleaning operation for recording heads is started at a low ink level.

2. Related Art

A type of printer is known that performs printing by ejecting ink supplied from an ink cartridge (ink tank) from a recording head onto a recording medium. This type of printer can fail to print successfully because of phenomena such as nozzle clogging due to increased ink viscosity resulting from evaporation of ink solvent from nozzle orifices of the recording head, deposition of dust on the nozzle orifices, and intrusion of bubbles into the nozzles upon replacement of the cartridge.

To recover the printer from such phenomena, as is known in the related art, a cleaning operation is performed by sucking ink from the nozzles of the recording head to eliminate the problems such as clogging, deposition of dust, and intrusion of bubbles at the nozzles of the recording head.

Specifically, as discussed in JP-A-2000-153622 (Patent Document 1), JP-A-2005-104089 (Patent Document 2), and JP-A-11-5300 (Patent Document 3), the cleaning operation is performed by a cleaning mechanism provided in a printer. The cleaning mechanism includes a cap, an ink drain channel communicating with the cap, and a pump provided somewhere in the ink drain channel. The nozzles of the recording head are covered with the cap before the pump is driven to reduce the inner pressure of the cap via the ink drain channel. This causes ink to be sucked from the nozzles of the recording head and drained into a waste ink tank, thus eliminating the problems such as nozzle clogging.

During the cleaning operation, the ink supply from the ink cartridge must not be interrupted because, for example, the ink drained into the cap, which has therefore been contaminated, would flow back, thus complicating maintenance.

Accordingly, whether or not the cleaning operation is permitted is determined with respect to the ink level. According to JP-A-2000-296627 (Patent Document 4), an ink-end level is set on the basis of the amount of ink stored in the ink tank, and notification requesting replacement of the ink tank is provided when a total ink consumption calculated by a soft counter or dot counter exceeds the ink-end level (see paragraphs 0044 and 0053-0055 of Patent Document 4). The total ink consumption is the sum of the cumulative ink consumption count and the consumption count for the next cleaning operation. The ink-end level is a predetermined level depending on the type of ink cartridge.

The above method, however, results in a significant cumulative error because the soft counter or dot counter counts the total ink consumption in such a manner that safety ejection is ensured to prevent ejection failure. This means that the determination that the cleaning operation is prohibited is made even if the ink actually remains in the ink tank. Hence, the replacement of the ink tank is requested even if the ink level is actually sufficient for cleaning. This applies not only to cleaning but also to printing.

Another approach uses an ink-level sensor built into an ink tank (ink cartridge) to detect ink depletion and provide notification requesting replacement of the ink tank. In the related art, however, the notification requesting replacement of the ink tank is provided before the sensor detects ink depletion because the total ink consumption exceeds the ink-end level.

In the second embodiment discussed in Patent Document 4, the ink tank is provided with a detection switch that is actuated by a mechanical ink-end sensor. A near-end point is detected when the detection switch is actuated, and afterwards a soft counter or dot counter is used to permit printing or cleaning on the basis of the amount of ink to be used in printing or cleaning (see paragraphs 0060-0066 and FIGS. 5 and 6 of Patent Document 4).

SUMMARY

An advantage of some aspects of the invention is that it provides a printing apparatus in which a cleaning operation is permitted until an ink-end sensor, mounted on an ink cartridge, that operates on the basis of ink pressure detects ink depletion with respect to a modified ink-end point.

A printing apparatus according to an aspect of the invention includes a recording head that prints an image in response to a printing command, an ink cartridge communicating with the recording head and storing an ink to be supplied to the recording head, an ink channel extending between the recording head and the ink cartridge, a cleaning mechanism that cleans the recording head with the ink stored in the ink cartridge in response to a cleaning command, and a determining unit that determines whether or not the recording head is permitted to start a printing operation and whether or not the cleaning mechanism is permitted to start a cleaning operation on the basis of the ink level of the ink cartridge. The ink cartridge includes an ink pack from which the ink is introduced under pressure and an ink-end sensor that detects an ink-end point on the basis of the pressure of the ink supplied from the ink pack under pressure. The ink pressure corresponding to the ink-end point detected by the ink-end sensor is set to a first pressure that is the minimum pressure near an outlet of the ink cartridge at which the recording head can print an image of predetermined quality. The determining unit permits starting of a printing or cleaning operation in response to a command issued before the ink-end sensor detects the ink-end point and prohibits starting of a printing or cleaning operation in response to a command issued after the ink-end sensor has detected the ink-end point.

In the above printing apparatus, the determining unit permits starting of a printing or cleaning operation in response to a command issued before the ink-end sensor detects the ink-end point (first pressure). In this case, the printing or cleaning operation may end after the ink-end sensor has detected the ink-end point. During printing, the ink-end sensor performs the detection operation regularly and determines that the ink has been depleted when it detects the ink-end point. The determining unit, on the other hand, prohibits starting of a printing or cleaning operation in response to a command issued after the ink-end sensor has detected the ink-end point. The determining unit can thus determine whether or not a printing or cleaning operation is permitted at a low ink level with respect to the ink-end point based on the ink pressure, which correlates with the ink level, without necessarily depending on a soft counter or dot counter. To meet various practical situations, nevertheless, a soft counter or dot counter may be used in combination, although a soft counter or dot counter used for another purpose is not necessary after the detection of the ink-end point and may therefore be stopped or reset after the detection of the ink-end point.

In the above printing apparatus, preferably, the ink channel includes a pressure-reducing valve upstream of the recording head, and the first pressure is calculated from the maximum pressure loss between the outlet of the ink cartridge and the center of the pressure-reducing valve in printing and the water head difference between the outlet of the ink cartridge and the center of the pressure-reducing valve. The pressure-reducing valve is a pressure control valve that opens when the pressure on the recording head side falls below a predetermined pressure. The pressure on the cartridge side does not affect the opening and closing of the pressure-reducing valve.

Although the first pressure may be set to the minimum pressure near the outlet of the ink cartridge at which the ink can be ejected from the recording head to print an image of predetermined quality, it may be calculated, as described above, from the pressure loss in the flow channel from the outlet of the ink cartridge to the center of the pressure-reducing valve in printing and the water head difference between the outlet of the ink cartridge and the center of the pressure-reducing valve. If the first pressure is set in view of the effects of the pressure loss and the water head difference in the flow channel, the ink can be constantly pumped to the pressure-reducing valve without a deficiency of ink supply. This allows the recording head to constantly eject droplets of predetermined size, thus ensuring print quality.

In the above printing apparatus, preferably, the first pressure is higher than lower limit pressure of a second pressure near the outlet of the ink cartridge below which a meniscus collapses in the recording head, and the amount of ink that can be supplied from the ink cartridge while the ink pressure changes from the first pressure to the lower limit pressure of second pressure is greater than or equal to the amount of ink consumed in cleaning.

The lower limit pressure of second pressure is the critical pressure at which the meniscus does not collapse in the nozzle surface of the recording head and no air intrudes; the ink ejection operation cannot be performed below the lower limit pressure of second pressure. The ink ejection operation can be prohibited below the second pressure if only starting of a printing or cleaning operation in response to a command, issued before the ink-end point (first pressure) is detected, is permitted and the amount of ink that can be supplied from the ink cartridge while the ink pressure changes from the first pressure to the lower limit pressure of second pressure is greater than or equal to the amount of ink consumed in cleaning. The amount of ink consumed in printing is often much greater than the amount of ink consumed in cleaning, but problems such as ejection failure can be avoided because the ink-end detection operation can be performed regularly (e.g., at the timing of regular flushing) during printing.

In the above printing apparatus, preferably, the second pressure is calculated from the meniscus strength of a nozzle of the recording head, the maximum pressure loss between the outlet of the ink cartridge and the recording head in printing, and the water head difference between the outlet of the ink cartridge and an outlet of the recording head. In this case, the second pressure can be set to a pressure at which the meniscus does not collapse in the recording head when it ejects the ink in cleaning.

In the above printing apparatus, the ink cartridge may include an ink-level detecting unit including an ink-detecting chamber, a moving member, and a detecting section. The ink-detecting chamber may include an ink inlet, an ink outlet, a flexible diaphragm that is displaced in response to the ink pressure between the ink inlet and the ink outlet, and a detecting-section mounting surface facing the diaphragm. The volume of the ink-detecting chamber may vary with the ink pressure. The moving member may be disposed in the ink-detecting chamber so as to move together with the diaphragm. The detecting section may be disposed on the detecting-section mounting surface and may include the ink-end sensor and a detecting space portion communicating with the ink-detecting chamber. The ink-end sensor may be a piezoelectric sensor that applies a vibration to the detecting space portion and detects a waveform of residual vibration following the vibration.

In the above printing apparatus, preferably, the ink-end sensor detects the amplitude or frequency of the waveform of residual vibration on the basis of the distance between the ink-end sensor and the moving member.

BRIEF DESCRIPTION OF THE DRAWINGS

The invention will be described with reference to the accompanying drawings, wherein like numbers reference like elements.

DESCRIPTION OF EXEMPLARY EMBODIMENTS

An ink-jet recording apparatus according to an embodiment of the invention will now be described with reference to the drawings. The embodiment described below does not unduly limit the scope of the invention in the appended claims, and not all elements described in the embodiment are essential for the invention.

Structure of Printing Apparatus

Figure 1:
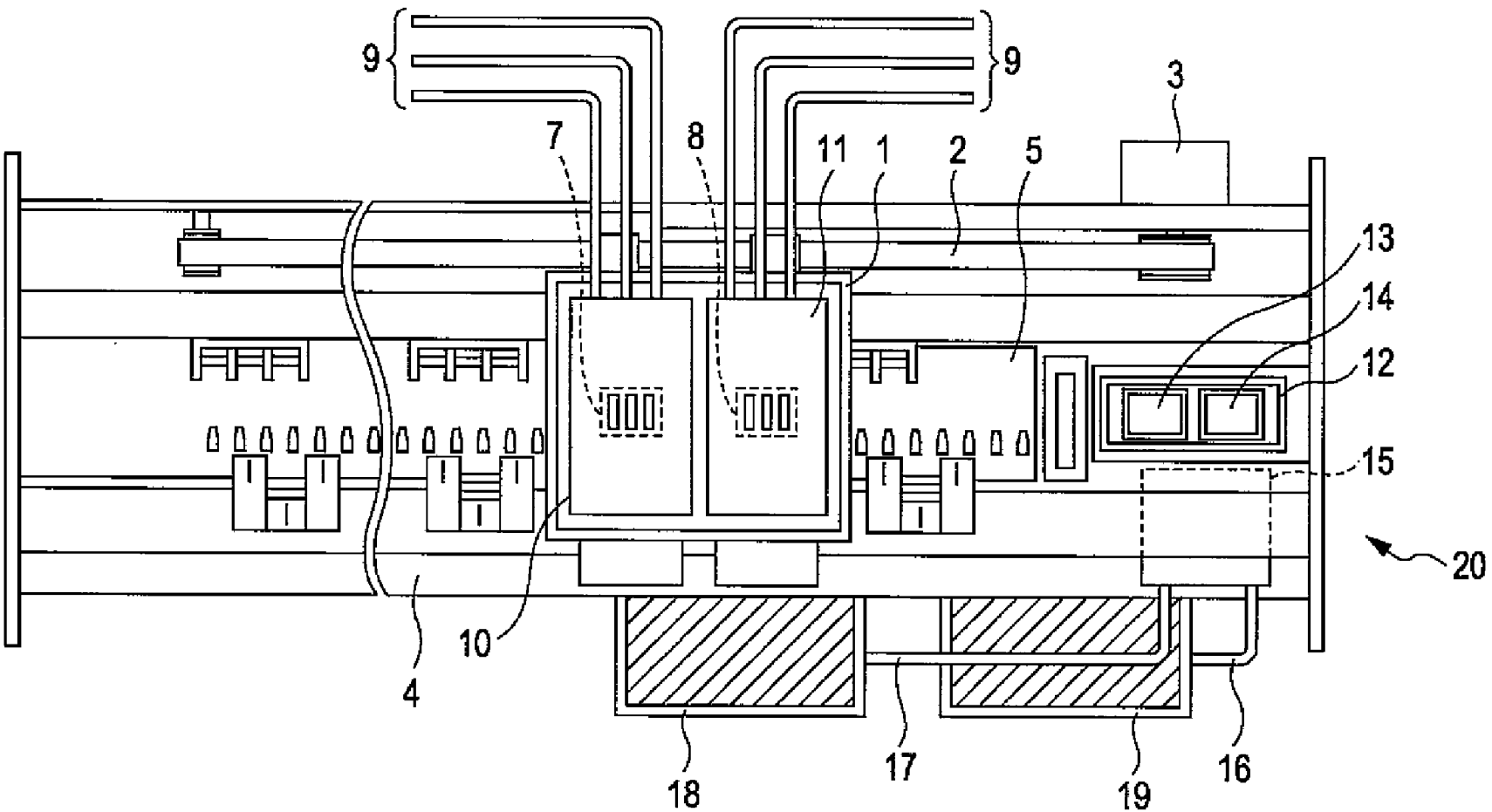
FIG. 1 is a top view of a printing apparatus according to an embodiment of the invention.

FIG. 1 is a top view of the printing apparatus according to the embodiment of the invention. In FIG. 1, a carriage 1 is driven by a carriage motor 3 via a timing belt 2 and is guided by a guiding member 4 so that it reciprocates in the longitudinal direction of a paper-guiding member 5. A first recording head 7 and a second recording head 8 are mounted on a surface of the carriage 1 opposite recording paper side by side in the direction in which the carriage 1 moves.

In addition, subtank units 10 and 11 with a damper function for supplying ink to the first and second recording heads 7 and 8 are mounted on the top surface of the carriage 1. These subtank units 10 and 11 are supplied with different inks from ink cartridges (not shown) via ink supply tubes 9.

In addition, a cleaning mechanism 20 for cleaning the recording heads (e.g., ink-jet heads) 7 and 8 are provided in a non-printing region on the pathway along which the recording heads 7 and 8 move. The cleaning mechanism 20 is a generic name for members 12 to 19 to be described below.

The cleaning mechanism 20 includes a capping unit 12 for sealing surfaces of the recording heads 7 and 8 in which nozzles are disposed, namely, nozzle plates, in the non-printing region.

The capping unit 12, as shown in FIG. 1, includes cap members 13 and 14 that move vertically to seal the recording heads 7 and 8, respectively, as the carriage 1 moves into the non-printing region.

A negative pressure simultaneously applied to the cap members 13 and 14 by driving a pump unit 15 drains ink from nozzle orifices of the recording heads 7 and 8 into the cap members 13 and 14. This causes bubbles and dust near the nozzle surfaces of the recording heads 7 and 8 to be sucked into the cap members 13 and 14.

The ink drained into the cap members 13 and 14 is sucked into tubes 16 and 17 and is drained into waste ink tanks 18 and 19.

Control Block

Figure 2:
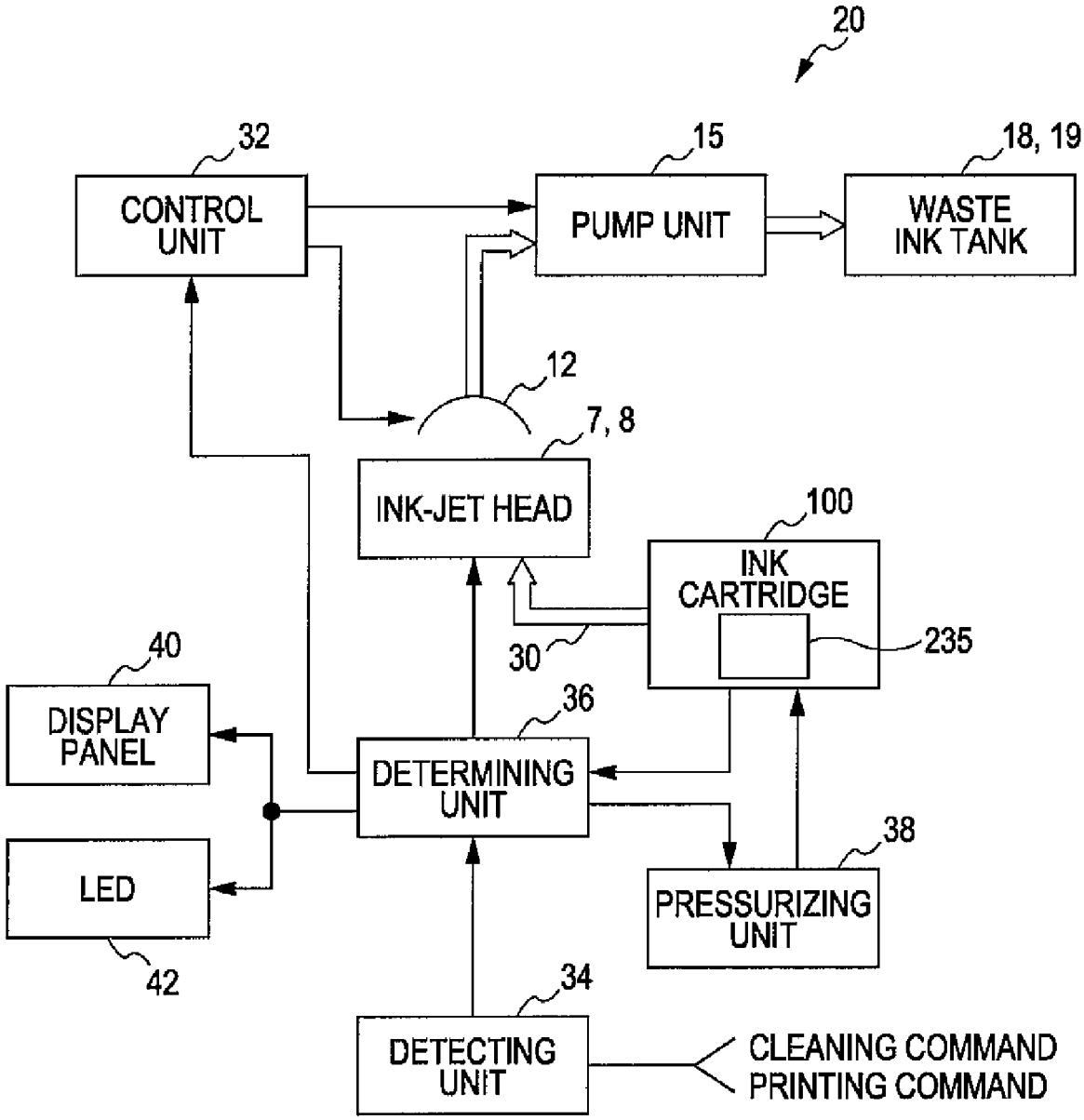
FIG. 2 is a control block diagram of the printing apparatus according to the embodiment.

FIG. 2 is a control block diagram of the printing apparatus according to this embodiment. In FIG. 2, an ink required for printing is supplied from an ink cartridge 100 having an ink-end sensor 235 into the recording heads 7 and 8 via an ink channel 30.

As the cleaning mechanism 20, FIG. 2 shows only the driving system described above, namely, the capping unit 12, the pump unit 15, and the waste ink tanks 18 and 19. The capping unit 12 and the pump unit 15 are controlled by a control unit 32.

A detecting unit 34 detects a cleaning or printing command issued by pushing a switch or setting a timer and transmits it to a determining unit 36. If different types of cleaning are available, the detecting unit 34 determines the type of cleaning on the basis of cleaning specification. The determining unit 36 determines whether or not a cleaning or printing operation is permitted on the basis of information concerning ink level from the ink-end sensor 235 of the ink cartridge 100 and a cleaning or printing command.

If the determining unit 36 permits the cleaning or printing operation, it directs the control unit 32 to start the operation.

The ink cartridge 100 in this embodiment supplies the ink under pressure. A pressurizing unit 38 constantly keeps an ink pack in the ink cartridge 100 under pressure unless the printing apparatus is in a suspend mode.

If the determining unit 36 prohibits the cleaning or printing operation, on the other hand, it provides notification requesting replacement of the ink cartridge 100 for a display panel 40 and an LED 42.

If the determining unit 36 notifies the control unit 32 of starting of a cleaning operation, the control unit 32 moves the recording heads 7 and 8 to a cleaning position, moves the capping unit 12 to the nozzle surfaces to cap them, and drives the pump unit 15 to suck waste ink.

Determining Unit

The determining unit 36 in this embodiment permits starting of a printing or cleaning operation in response to a command issued before the ink-end sensor 235 detects an ink-end point and prohibits starting of a printing or cleaning operation in response to a command issued after the ink-end sensor 235 has detected the ink-end point.

Figure 3:
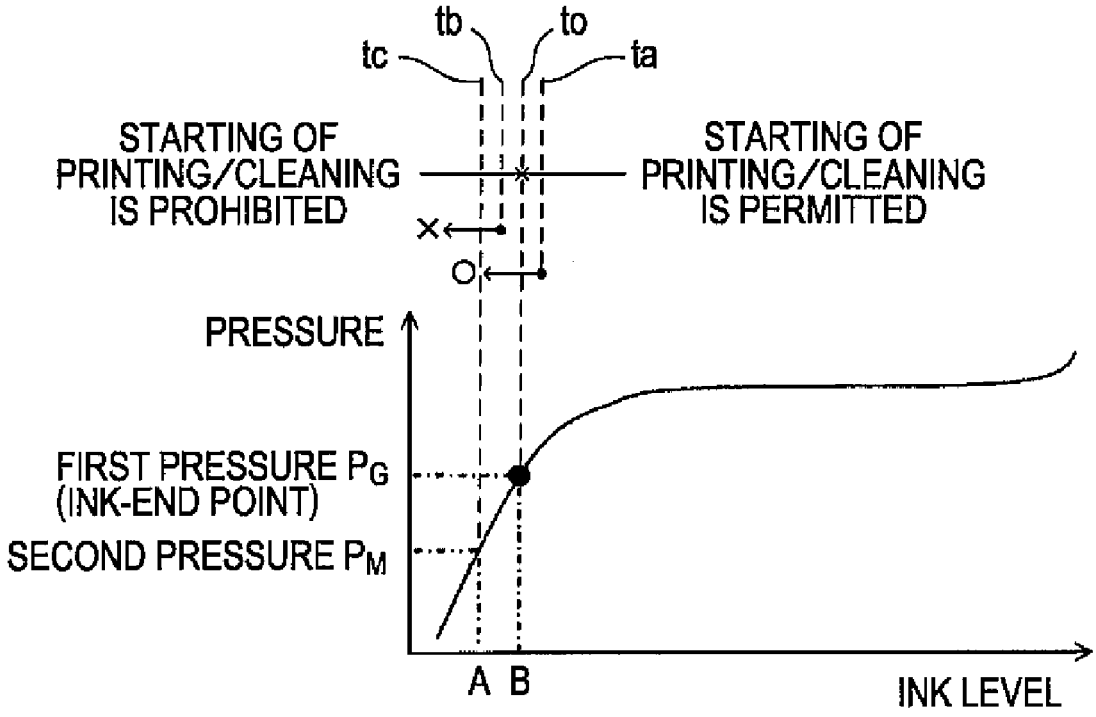
FIG. 3 is a characteristic graph showing the relationship between determination results from a determining unit and ink pressure in an ink cartridge.
Figure 4:
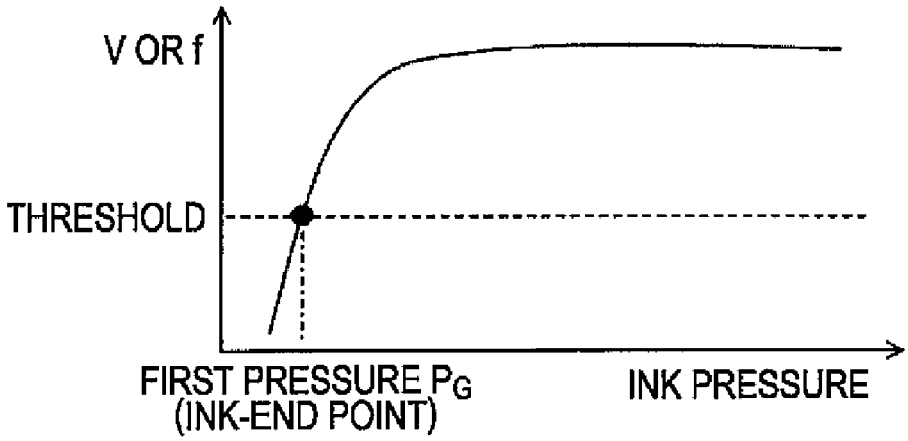
FIG. 4 is a characteristic graph showing how an ink-end sensor detects an ink-end point.

The setting of the ink-end point required for the determination will now be described with reference to FIGS. 3 and 4. FIG. 3 is a graph showing the relationship between determination results from the determining unit 36 and the ink pressure in the ink cartridge 100. FIG. 4 is a graph showing how the ink-end sensor 235 detects the ink-end point.

FIG. 3 shows the relationship between the ink pressure in the ink cartridge 100 and the ink level. The ink pressure decreases with decreasing ink level. FIG. 4 shows the relationship between the ink pressure in the ink cartridge 100 and the amplitude V or frequency f of residual vibration output from the ink-end sensor 235, as described later.

In this embodiment, when the ink pressure decreases to a first pressure $P_G$ shown in FIG. 3, the output (amplitude V or frequency f) of the ink-end sensor 235 reaches a threshold, as shown in FIG. 4, so that the ink-end sensor 235 detects the ink-end point.

In this embodiment, the first pressure $P_G$, corresponding to the ink-end point detected by the ink-end sensor 235, is set to the minimum pressure near an outlet of the ink cartridge 100 at which the recording heads 7 and 8 can print an image of predetermined quality.

As shown in FIG. 3, the determining unit 36 permits starting of a printing or cleaning operation in response to a command issued at time ta before time t0, at which the ink-end sensor 235 detects the ink-end point (first pressure $P_G$). In this case, the cleaning or printing operation may end after time t0, at which the ink-end sensor 235 detects the ink-end point. The determining unit 36, on the other hand, prohibits starting of a printing or cleaning operation in response to a command issued at time tb after time t0, at which the ink-end sensor 235 detects the ink-end point. The determining unit 36 can thus determine whether or not starting of a printing or cleaning operation is permitted at a low ink level with respect to the ink-end point based on the ink pressure, which correlates with the ink level, without depending on a soft counter or dot counter.

The maximum amount of ink consumed in cleaning or printing of predetermined unit does not exceed the difference between ink levels B and A (B−A) in FIG. 3 so that a cleaning or printing operation started before the ink pressure reaches the first pressure $P_G$ ends before time tc, at which the ink pressure reaches a second pressure $P_M$ at which ink-ejection operation should be prohibited. The determining unit 36, on the other hand, prohibits a cleaning or printing operation started after time t0, at which the ink pressure reaches the first pressure $P_G$, and requests replacement of the ink cartridge 100 because the operation could end after time tc, at which the ink pressure reaches the lower limit pressure of second pressure $P_M$.

The lower limit pressure of second pressure $P_M$ is the critical pressure at which menisci do not collapse at the nozzle surfaces of the recording heads 7 and 8 and no air intrudes; the ink ejection operation cannot be performed below the second pressure $P_M$. The menisci are surface state of ink at the nozzle, which are made by boundary tension of the ink.

In this embodiment, as described above, the determining unit 36 determines whether or not starting of a cleaning or printing operation of the predetermined printing unit is permitted only on the basis of time t0, at which the ink-end sensor 235 detects the ink-end point, and the time at which a cleaning or printing command is issued. Unlike the related art, therefore, the determination can be performed without depending only on a soft counter or dot counter, which would cause a cumulative error, so that an unnecessary amount of ink does not remain in the ink cartridge 100 at the time of replacement.

In addition, because the ink pressure in the ink cartridge 100 correlates with the ink level, as shown in FIG. 3, and the ink-end sensor 235 detects the ink-end point on the basis of the ink pressure, as shown in FIG. 4, the ink-end sensor 235 can precisely detect the first pressure $P_G$ (ink-end detection pressure), on which the determining unit 36 depends for its determination. This advantage cannot be achieved by the method using a mechanical sensor according to Patent Document 4.

First and Second Pressures

Figure 5:
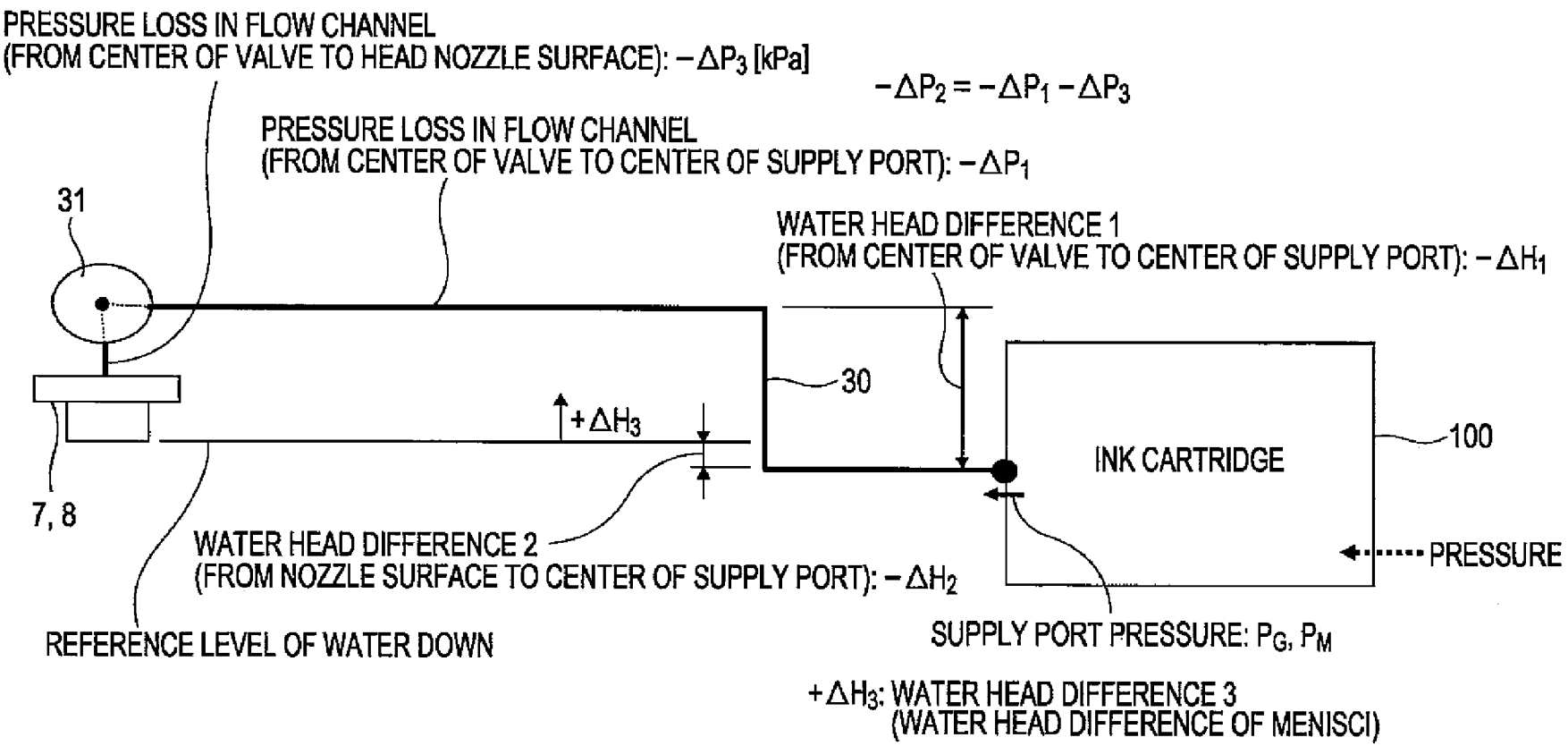
FIG. 5 is a diagram illustrating pressure loss and water head difference in a flow channel extending from the ink cartridge to a recording head via an ink channel.

Next, the first and second pressures $P_G$ and $P_M$ will be described with reference to FIG. 5. FIG. 5 is a diagram illustrating pressure loss and water head difference in the flow channel extending from the ink cartridge 100 to the recording heads 7 and 8 via the ink channel 30. In this embodiment, as shown in FIG. 5, the ink channel 30 has a valve that opens when a predetermined negative pressure is reached on the recording head side, for example, a pressure-reducing valve 31, upstream of the recording heads 7 and 8. Even though the pressure in the ink supply channel up to the pressure-reducing valve 31 upstream of the recording heads 7 and 8 varies with the ink level of the ink cartridge 100, the effect of such variations on the recording head side can be eliminated by the pressure-reducing valve 31.

In this embodiment, the first pressure $P_G$, which is set to ensure image quality, is calculated from the maximum pressure loss ($-\Delta P_1$) in the flow channel from the outlet of the ink cartridge 100 to the center of the valve 31 in printing and the water head difference 1 ($-\Delta H_1$) between the outlet of the ink cartridge 100 and the center of the valve 31, as reference level of the water head is a level of the nozzle surface. That is, the first pressure $P_G$ is calculated by the following equation:

$$\text{first pressure } (P_G) = |\text{maximum pressure loss } (-\Delta P_1) + \text{water head difference 1 } (-\Delta H_1)|$$

Hence, if the pressurizing unit 38 shown in FIG. 2 pressurizes the ink in the ink cartridge 100 to the extent that the pressure near the outlet (supply port) of the ink cartridge 100 exceeds the first pressure $P_G$, the ink can be constantly pumped to the valve 31 without a deficiency of ink supply even under the effects of the pressure loss and the water head difference in the ink channel 30 in FIG. 5. This allows the recording heads 7 and 8 to constantly eject droplets of predetermined size, thus ensuring print quality. Accordingly, the first pressure $P_G$ can be used as the ink-end point to ensure print quality by prohibiting starting of a printing operation after detecting the ink-end point.

The maximum pressure loss in the flow channel in printing is the channel loss at the maximum flow rate and in a low temperature range, in which the ink viscosity is maximized. The maximum pressure loss is calculated by the equation $-\Delta P_1 = Q_1 \times R_1$ (Pa), where $Q_1$ ($m^3/s$) is the maximum flow rate in printing and $R_1$ ($Pa \cdot s/m^3$) is flow resistance.

Although the first pressure $P_G$ may be calculated as described above, it may instead be determined in practical printing by monitoring the minimum pressure near the outlet (supply port) of the ink cartridge 100 at which dots can be printed with predetermined print quality. Alternatively, the output of the ink-end sensor 235 built into the ink cartridge 100 may be monitored. In this case, the first pressure $P_G$ is set on the basis of the output of the ink-end sensor 235, which detects the first pressure $P_G$ as the ink-end point, so that no correction is required for factors such as the channel loss in the pathway to the ink-end sensor 235 and the outlet (supply port 109) of the ink cartridge 100. In other cases, the end-point pressure can be set by correcting the first pressure $P_G$ on the basis of the factors such as the channel loss in the pathway to the ink-end sensor 235 and the outlet (supply port 109) of the ink cartridge 100.

Next, the second pressure $P_M$ will be discussed. The lower limit pressure of second pressure $P_M$, as described above, is the pressure near the outlet of the ink cartridge 100 below which menisci collapse at the nozzle surfaces of the recording heads 7 and 8. The pressure on the recording head side at which the valve 31 shown in FIG. 5 opens is usually set to a pressure higher than the pressure at which the menisci collapse at the recording heads 7 and 8. Hence, the pressure range below the first pressure $P_G$ includes a range in which the pressure in the flow channel on the ink cartridge side of the valve 31 is lower than the pressure at which the valve 31 opens and in which the valve 31 remains open. In this state, if the menisci collapse at the nozzles of the recording heads 7 and 8 after cleaning, contaminated ink drained from the nozzles of the recording heads 7 and 8 into the capping unit 12 shown in FIGS. 1 and 2 flow back together with air along the ink channel 30 because the valve 31 remains open. This backflow continues until the pressure in the ink channel 30 increases to the pressure at which the menisci are restored.

This is a phenomenon that manufacturers must avoid because it would complicate maintenance of the recording heads 7 and 8 and the ink channel 30. In this embodiment, therefore, the determination of whether or not starting of a printing or cleaning operation is permitted is made with respect to the first pressure $P_G$ so that the pressure near the outlet of the ink cartridge 100 does not reach the second pressure $P_M$ at the end of the operation.

The lower limit pressure of second pressure $P_M$, which is set to prevent the menisci from collapsing, is calculated from the meniscus strength ($+\Delta H_3$) of the nozzles of the recording heads 7 and 8 and the water head difference 2 ($-\Delta H_2$) between the outlet of the ink cartridge 100 and the nozzle surfaces of the recording heads 7 and 8, The meniscus strength is called water down difference of menisci, which is pressure at the menisci are disappear. That is, the second pressure $P_M$ is calculated by the following equation:

$$\text{second pressure } (P_M) = |\text{meniscus strength } (+\Delta H_3) + \text{water head difference 2 } (-\Delta H_2)|$$

To permit ink ejection from the recording heads 7 and 8 during a cleaning operation (flushing) or printing after cleaning (without ensuring image quality), the second pressure $P_M$ is calculated from the meniscus strength ($+\Delta H_3$) of the nozzles of the recording heads 7 and 8, the maximum pressure loss ($-\Delta P_2$) in the flow channel from the outlet of the ink cartridge 100 to the nozzles of the recording heads 7 and 8 in printing, and the water head difference 2 ($-\Delta H_2$) between the outlet of the ink cartridge 100 and the nozzle surfaces of the recording heads 7 and 8. That is, the second pressure $P_M$ is calculated by the following equation:

$$\text{second pressure } (P_M) = |\text{meniscus strength } (+\Delta H_3) + \text{maximum pressure loss } (-\Delta P_2) + \text{water head difference 2 } (-\Delta H_2)|$$

In FIG. 3, the amount of ink (B−A) corresponding to the difference between the first pressure $P_G$ and the second pressure $P_M$ is greater than or equal to the maximum amount of ink (Q) consumed in cleaning ($Q \leqq B-A$). In this case, if the determining unit 36 permits starting of a cleaning operation in response to a command issued at time ta before time t0, at which the ink-end sensor 235 detects the ink-end point (first pressure $P_G$), the lower limit pressure of second pressure $P_M$ is not reached before the operation ends.

Cleaning Process

Figure 6:
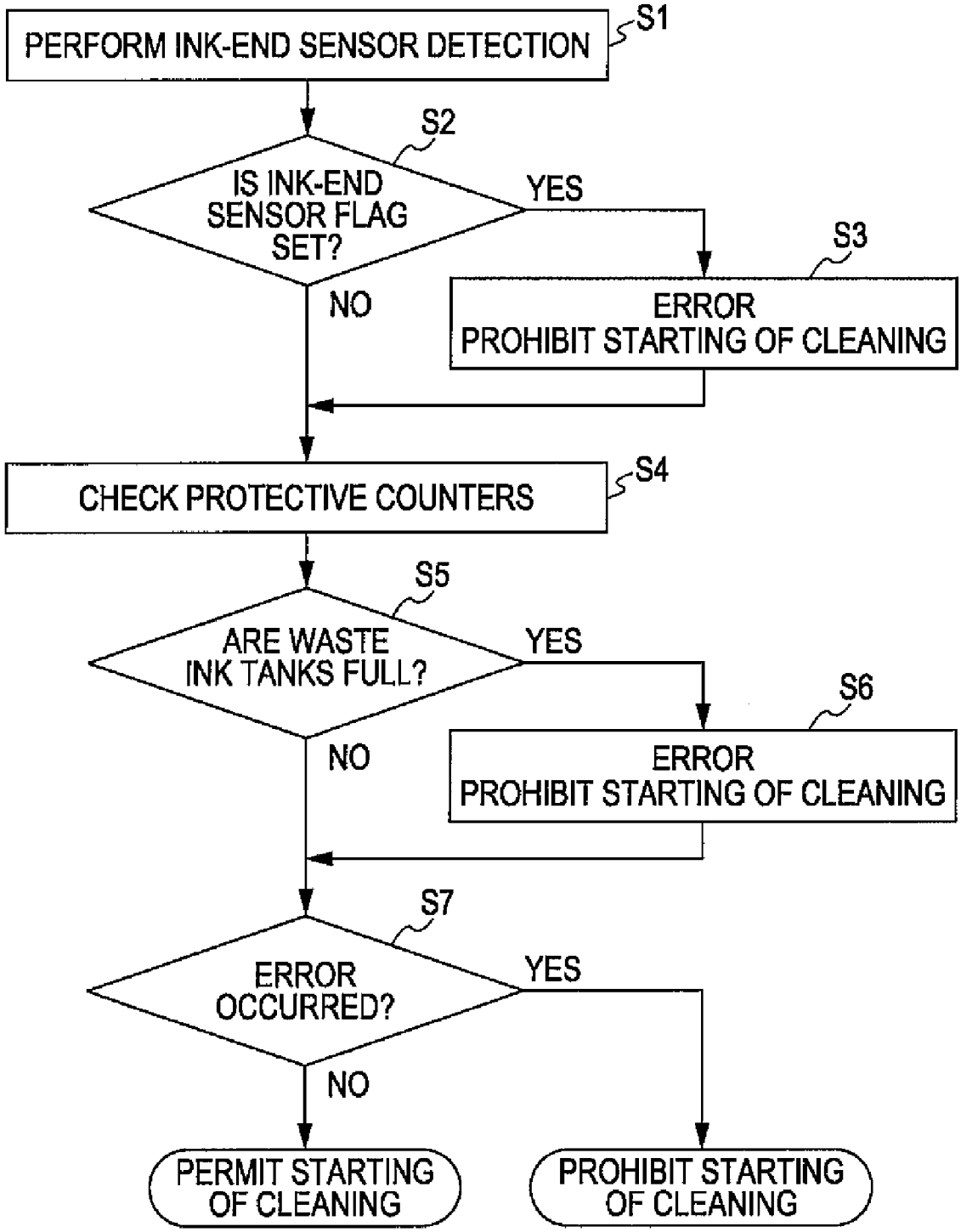
FIG. 6 is a flowchart of a cleaning process.

Next, a cleaning process according to this embodiment will be described with reference to FIG. 6. In FIG. 6, the ink-end sensor 235 built into the ink cartridge 100 detects whether or not the ink-end point has been reached (Step S1). Next, the determining unit 36 shown in FIG. 2 determines whether or not an ink-end-sensor flag has been set in, for example, the determining unit 36 (Step S2). The ink-end-sensor flag is set in, for example, a storage section of the determining unit 36 when the ink-end sensor 235 detects the ink-end point.

If the determination in Step S2 is "YES", the process proceeds to Step S3; if it is "NO", the process proceeds to Step S4. In Step S3, in which an error has occurred, the determining unit 36 prohibits starting of a cleaning operation even if a cleaning command has been issued.

In Step S4, the determining unit 36 checks protective counters for the waste ink tanks 18 and 19. The protective counters mean, for example, that the determining unit 36 performs soft counting on the basis of the amount of ink consumed in cleaning and the number of cleaning operations. On the basis of the protective counts, the determining unit 36 determines whether or not the waste ink tanks 18 and 19 are full (Step S5).

If the determination in Step S5 is "YES", the process proceeds to Step S6; if it is "NO", the process proceeds to Step S7. In Step S6, in which an error has occurred, the determining unit 36 prohibits starting of a cleaning operation even if a cleaning command has been issued because one of the waste ink tanks 18 and 19 is full.

In Step S7, the determining unit 36 determines whether or not an error has been occurred in Step S3 or S6. If the determination in Step S7 is "YES", the determining unit 36 prohibits starting of a cleaning operation; if it is "NO", the determining unit 36 permits starting of a cleaning operation.

Ink Cartridge

Figure 7:
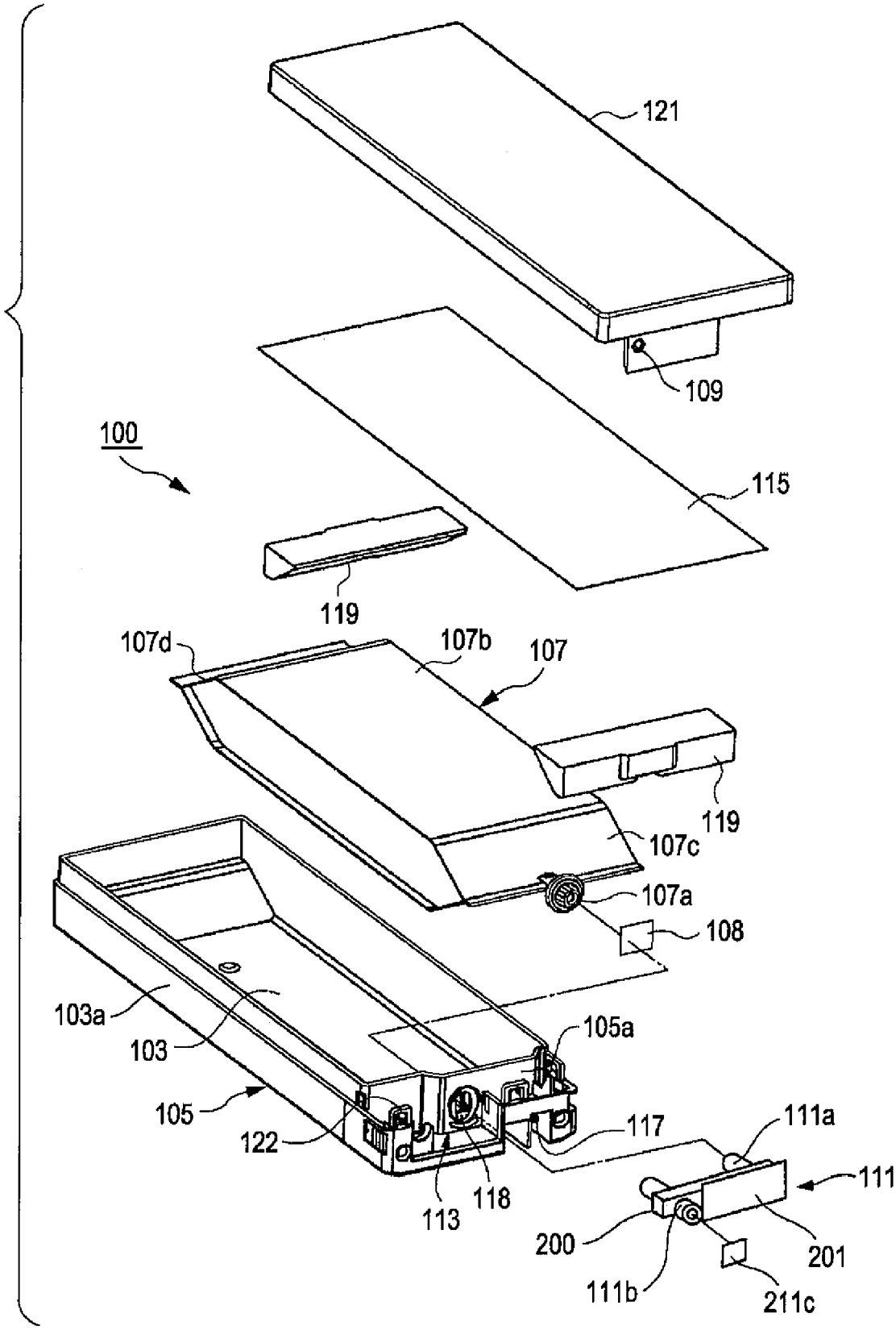
FIG. 7 is an exploded perspective view of the ink cartridge.

Next, an example of the ink cartridge 100 will be described. FIG. 7 is an exploded perspective view of the ink cartridge 100. The ink cartridge 100 is attached to a cartridge-mounting section of the above printing apparatus so as to be detachable therefrom. In FIG. 7, the ink cartridge 100 includes a container body 105 having a pressurizing chamber 103 into which a pressurizing fluid is introduced from the pressurizing unit 38 shown in FIG. 2; an ink pack 107 storing an ink that is discharged through an ink-introducing member 107*a* when pressurized by the pressurizing chamber 103; an ink supply port 109 through which the ink is supplied to the recording heads 7 and 8 of the printing apparatus; and an ink-detecting unit 111 disposed between the ink pack 107 and the ink supply port 109 to detect the ink level.

The container body 105 includes a pack-accommodating section 103*a* and a detecting-unit accommodating section 113 accommodating the ink-detecting unit 111.

An opening plane of the pack-accommodating section 103*a* is sealed with a sealing film 115 after the ink pack 107 is accommodated therein so that the pressurizing chamber 103 is hermetically sealed. A partition 105*a* separating the detecting-unit accommodating section 113 from the pack-accommodating section 103*a* has a pressurizing port 117 through which the pressurizing fluid is supplied into the pressurizing chamber 103. After the ink cartridge 100 is attached to the printing apparatus, the ink pack 107 can be pressurized via the pressurizing port 117 and the pressurizing chamber 103.

The cylindrical ink-introducing member 107*a* is joined to one end of a flexible pack member 107*b* of the ink pack 107. A connection needle 111*a* of the ink-detecting unit 111 is inserted into and connected to the ink-introducing member 107*a*. The ink-introducing member 107*a* of the ink pack 107 is hermetically inserted into a connection-port insertion opening 118 formed in the partition 105*a*. A leading end of the ink-introducing member 107*a* protrudes into the detecting-unit accommodating section 113. The ink pack 107 is filled with a highly degassed ink and is sealed with a sealing film 108 before being connected to the ink-detecting unit 111. After the ink pack 107 is attached to the pack-accommodating section 103*a*, resin spacers 119 are attached to front and rear sloped portions 107*c* and 107*d* of the flexible pack member 107*b*. This prevents the ink pack 107 from becoming unstable against impacts and vibrations inside the pack-accommodating section 103*a*.

When the ink-detecting unit 111 is attached to the detecting-unit accommodating section 113, the connection needle 111*a* pierces the sealing film 108 and actuates a valve mechanism (not shown) provided in the ink-introducing member 107*a* to allow the ink to be introduced therefrom.

A resin cover 121 is disposed on the detecting-unit accommodating section 113 and the sealing film 115. When the cover 121 is disposed on the container body 105, engaging members (not shown) engage with engaging portions 122 of the container body 105 so that the cover 121 is fixed to the container body 105.

Ink-Detecting Unit

Figure 8:
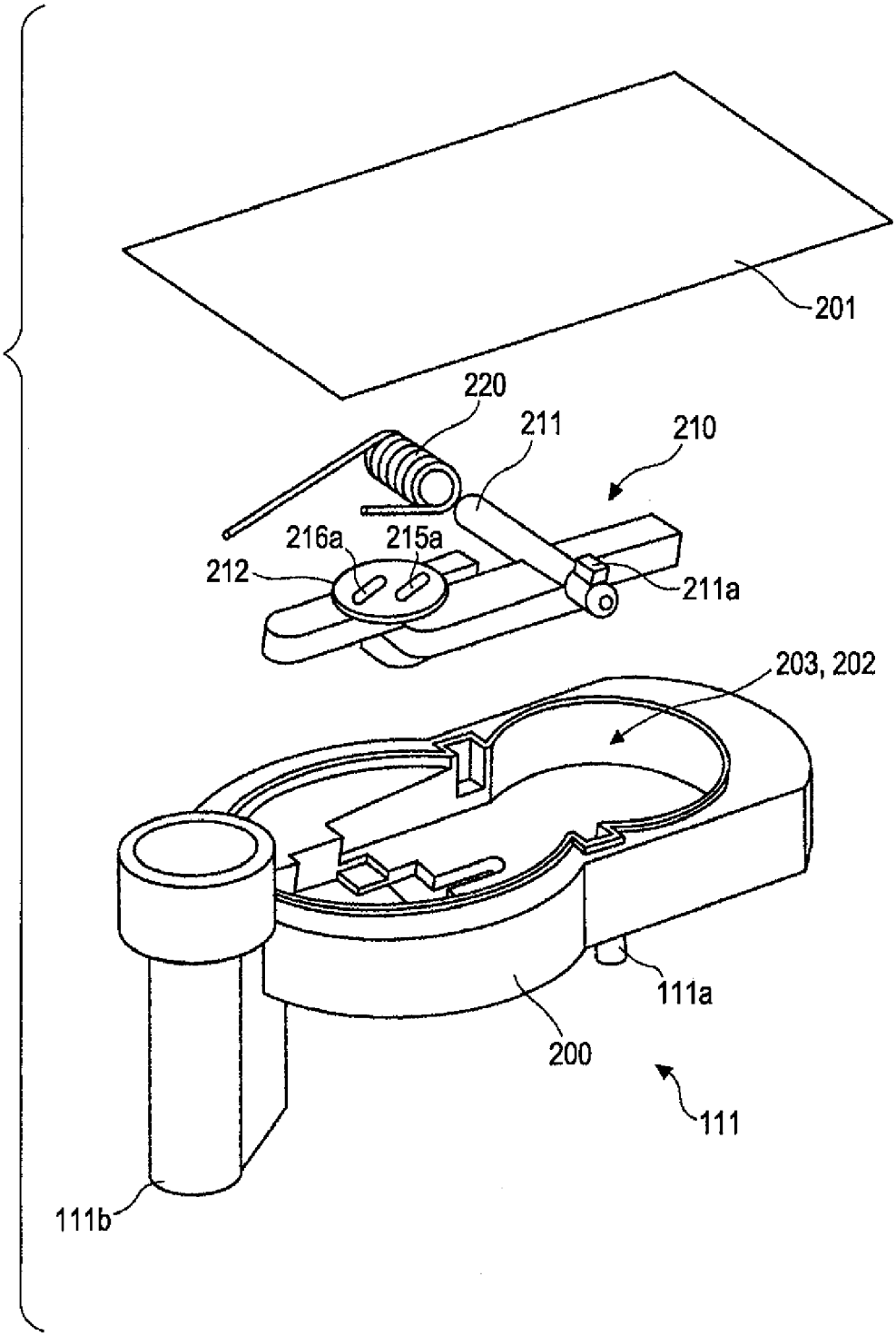
FIG. 8 is an exploded perspective view of an ink-detecting unit shown in FIG. 7.
Figure 9:
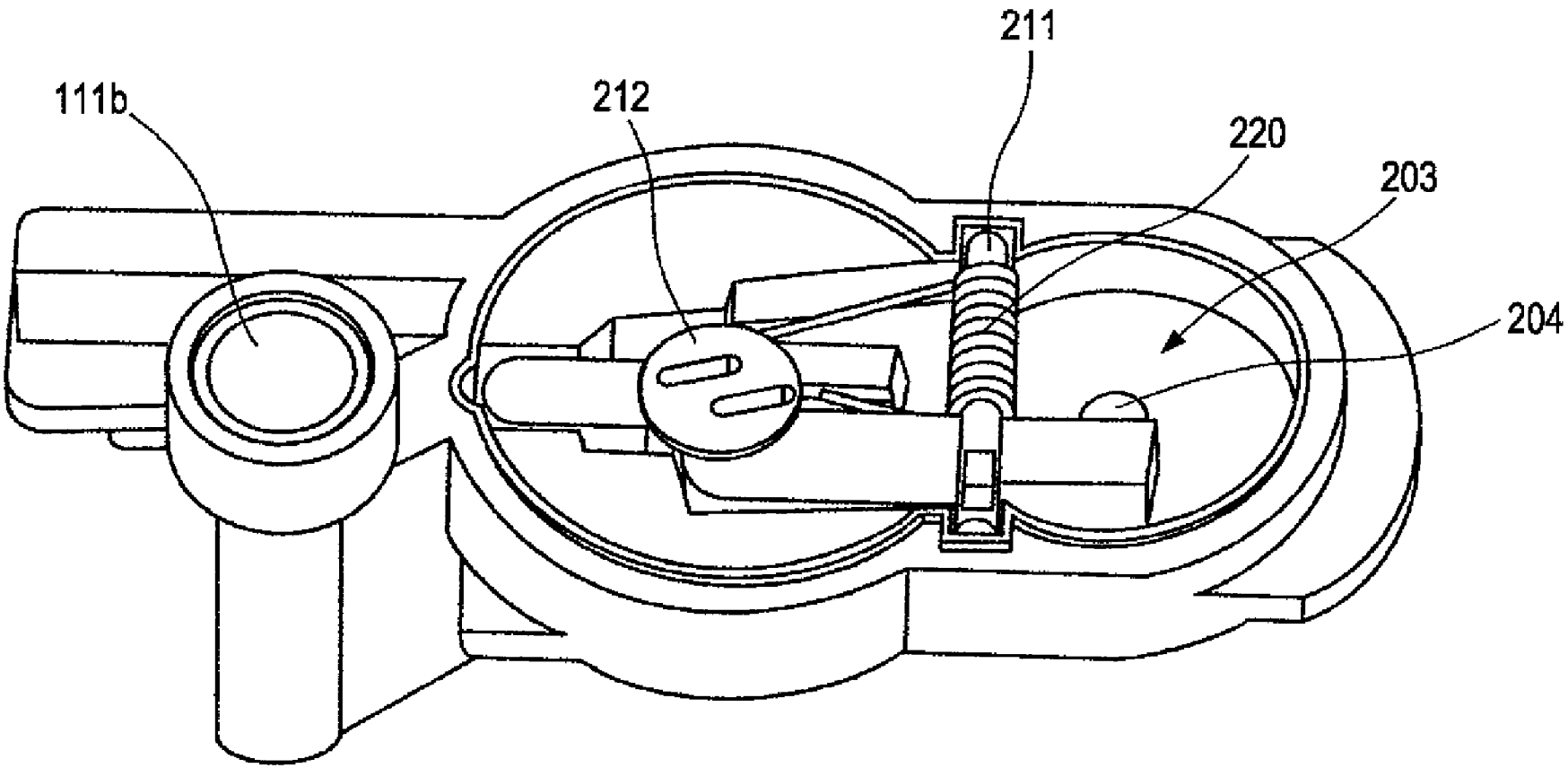
FIG. 9 is a schematic perspective view of a unit body shown in FIG. 7 with a moving member and a spring accommodated therein.
Figure 10:
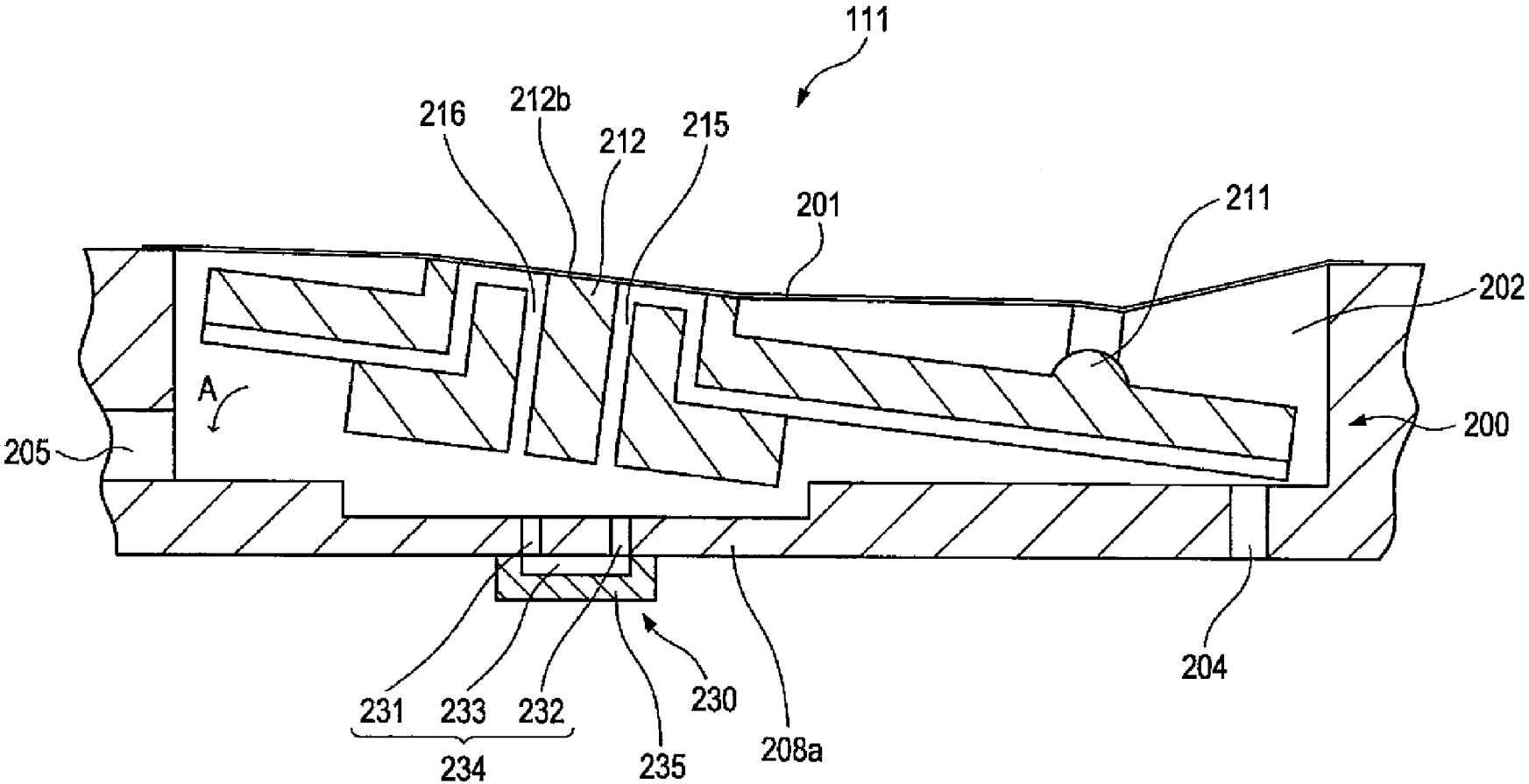
FIG. 10 is a sectional view of the ink-detecting unit with an ink pack being full.
Figure 11:
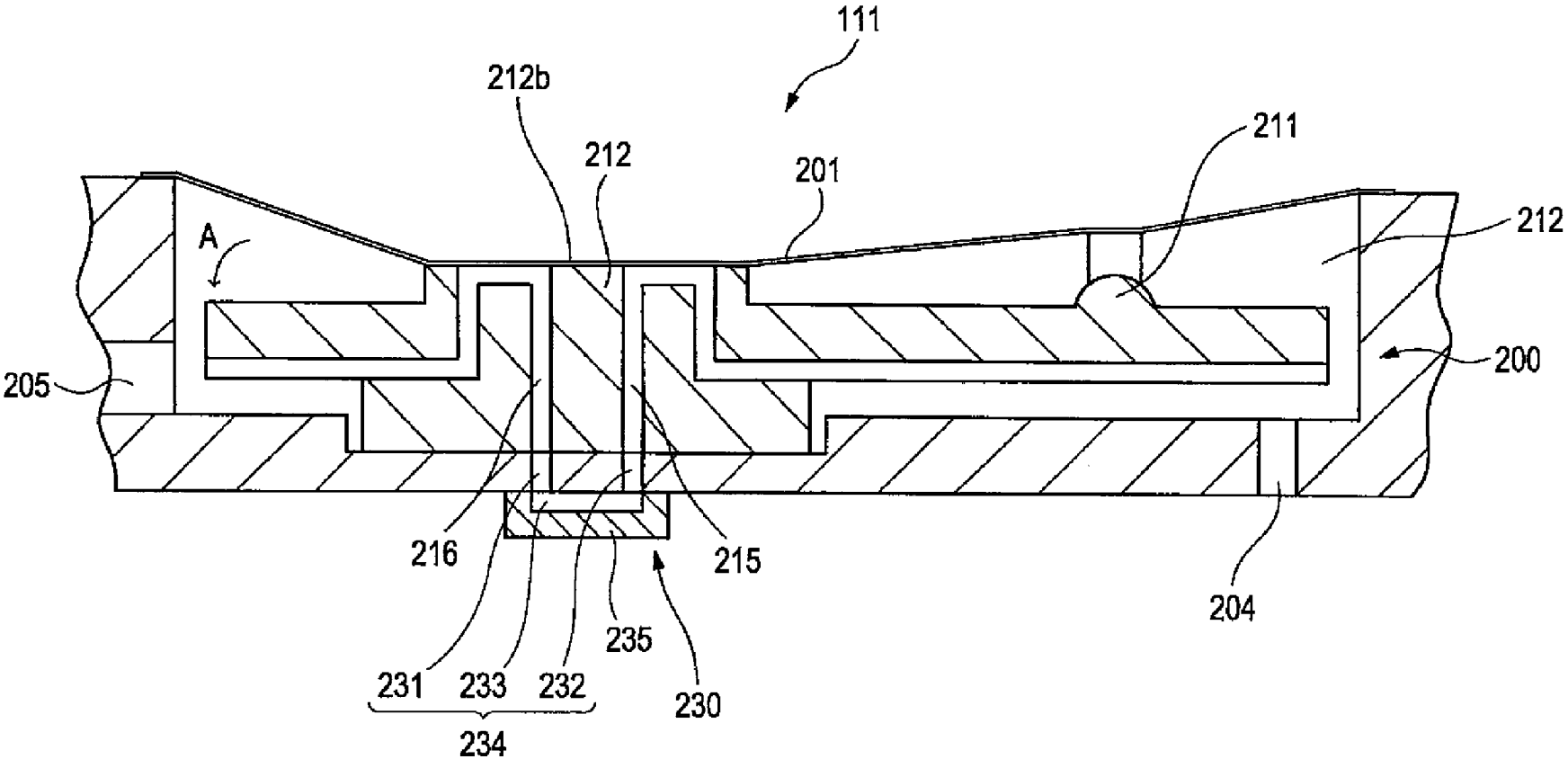
FIG. 11 is a sectional view of the ink-detecting unit with the ink pack being empty.

FIG. 8 is an exploded perspective view of the ink-detecting unit 111. FIG. 9 is a schematic perspective view of the ink-detecting unit 111 after assembly with its diaphragm omitted. FIG. 10 is a sectional view of the ink-detecting unit 111 with the ink pack 107 being full. FIG. 11 is a sectional view of the ink-detecting unit 111 with the ink pack 107 being empty. FIGS. 10 and 11 are sectional view taken along a flow channel formed across a moving member 210 between an ink inlet 204 and an ink outlet 205.

The ink-detecting unit 111 in this embodiment detects the ink level while the ink flows into an ink-detecting chamber 202 (see FIGS. 8, 9, and 10) via the connection needle 111*a* (see FIGS. 7 and 8) and the ink inlet 204 (see FIGS. 9 and 10) on the backside of a unit body 200 and flows out via the ink outlet 205 (see FIG. 10) and an ink-introducing member 111*b* (see FIGS. 8 and 9). A sealing film 211*c* shown in FIG. 7 seals an outlet of the ink-introducing member 111*b* in a liquid-tight manner. When the ink cartridge 100 is attached to the printing apparatus, an ink-introducing needle of the printing apparatus pierces the sealing film 211*c* to enter the ink-introducing member 111*b*.

The ink-detecting unit 111, as shown in FIG. 8, includes the unit body 200, the moving member 210, a torsion coil spring 220, and a diaphragm 201 sealing the unit body 200. The moving member 210 is disposed in a recess 203 of the unit body 200.

As shown in FIG. 10, the ink inlet 204 is disposed at one end of the recess 203 of the unit body 200 in the longitudinal direction, and the ink outlet 205 is disposed at the other end of the recess 203. The ink inlet 204 communicates with the connection needle 111*a* (see FIGS. 7 and 8) of the ink-detecting unit 111.

The moving member 210 pivots about a pivot shaft 211 in the ink-detecting chamber 202. A pressure-receiving plate 212 is disposed at a position on the moving member 210 away from the pivot shaft 211. The top surface 212*b* of the pressure-receiving plate 212 faces the diaphragm 201.

The pressure-receiving plate 212 has a first flow channel 215 through which the ink flows from the ink inlet 204 into a detecting space portion 234, as described later, and a second flow channel 216 through which the ink flows from the detecting space portion 234 into the ink outlet 205. As shown in FIGS. 8 and 10, the portions of the first and second flow channels 215 and 216 in the top surface 212*b* of the pressure-receiving plate 212 are formed by sealing openings 215*a* and 215*b* in the top surface 212*b* of the pressure-receiving plate 212 with the diaphragm 201.

The pressure-receiving plate 212 of the moving member 210 is biased in the direction indicated by arrow A in FIGS. 10 and 11 by the torsion coil spring 220, which serves as an example of a biasing member. The diaphragm 201 is attached to the unit body 200 and the pressure-receiving plate 212 of the moving member 210 by heat welding.

As the ink pressure in the ink-detecting chamber 202 varies, the moving member 210 pivots and displaces the pressure-receiving plate 212. The displacement of the pressure-receiving plate 212 is accompanied by displacement of the diaphragm 201 attached to the pressure-receiving plate 212, thus changing the volume of the ink-detecting chamber 202.

Ink-Detecting Section

As shown in FIGS. 10 and 11, an ink-detecting section 230 of the ink-detecting unit 111 includes the detecting space portion 234, which includes ink-guiding channels 231 and 232 extending through a bottom wall 208*a* of the unit body 200 and an ink-guiding channel 233 communicating with the ink-guiding channels 231 and 232. The ink-detecting section 230 also includes the ink-end sensor 235, for example, a piezoelectric sensor, which is disposed adjacent to the detecting space portion 234 so as to define the detecting space portion 234 with the bottom wall 208*a*. The ink-end sensor 235 applies a vibration to the detecting space portion 234 and detects the waveform of residual vibration following that vibration.

The ink-end sensor 235 can detect different waveforms of residual vibration depending on whether or not the pressure-receiving plate 212 covers the ink-guiding channels 231 and 232. The detection mechanism is disclosed in Patent Document 1.

Figure 12A:
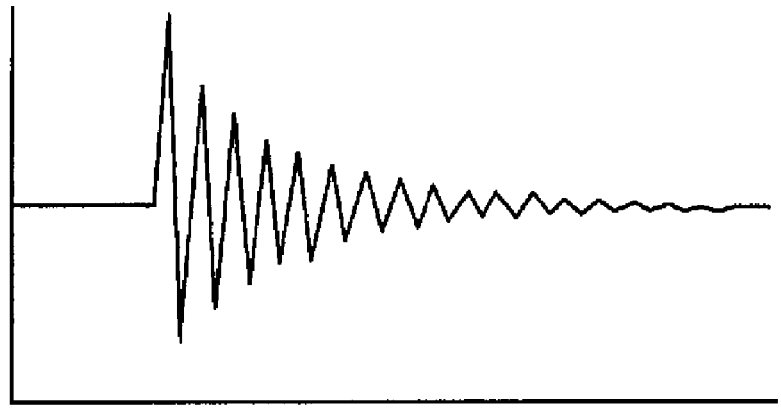
FIG. 12A is a characteristic graph showing a waveform of residual vibration with a smaller attenuation.
Figure 12B:
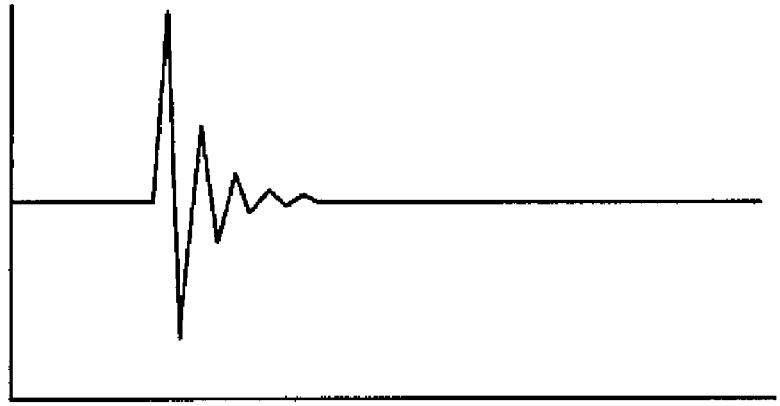
FIG. 12B is a characteristic graph showing a waveform of residual vibration with a larger attenuation.

For example, a waveform of residual vibration shown in FIG. 12A is observed if the ink-end sensor 235 applies a vibration to the detecting space portion 234 while the ink is being supplied from the ink pack 107 under pressure, as shown in FIG. 10. On the other hand, for example, a waveform of residual vibration shown in FIG. 12B is observed if the ink-end sensor 235 applies a vibration to the detecting space portion 234 while no ink is being supplied from the ink pack 107, as shown in FIG. 11. Thus, the waveform of residual vibration differs in attenuation depending on the distance from the ink-end sensor 235 to the rigid pressure-receiving plate 212. Hence, the ink-end state of the ink pack 107 in FIG. 11 can be distinguished from that in FIG. 10 by, for example, comparing with the threshold shown in FIG. 4 the amplitude of the waveform of residual vibration at the time when a predetermined period of time elapses after the ink-end sensor 235 applies a vibration. This detection may instead be performed by counting the duration of residual vibration or the frequency of the waveform of residual vibration.

In this embodiment, the ink-end sensor 235 detects the ink-end point, which indicates that the ink in the ink pack 107 has been depleted, by detecting the waveform of residual vibration observed in the state of FIG. 11. In this case, the ink pressure corresponding to the ink-end point is set to the first pressure $P_G$, as shown in FIG. 4, to ensure image quality.

While the embodiment has been described in detail above, it will readily be appreciated by those skilled in the art that various modifications are possible without substantially departing from the new matters and advantages of the invention; therefore, such modifications are all included in the scope of the invention. For example, terms used together with different broader or synonymous terms at least once in the specification or the drawings can be replaced with those different terms in any section of the specification and the drawings.

The entire disclosure of Japanese Patent Application No. 2008-039670, filed Feb. 21, 2008 is expressly incorporated by reference herein.

What is claimed is:

1. A printing apparatus comprising:

a recording head that prints an image in response to a printing command;

an ink cartridge communicating with the recording head and storing an ink to be supplied to the recording head;

an ink channel extending between the recording head and the ink cartridge;

a cleaning mechanism that cleans the recording head with the ink stored in the ink cartridge in response to a cleaning command; and a determining unit that determines whether or not the recording head is permitted to start a printing operation and whether or not the cleaning mechanism is permitted to start a cleaning operation on the basis of the ink level of the ink cartridge;

the ink cartridge including:

an ink pack from which the ink is introduced under pressure; and an ink-end sensor that detects an ink-end point on the basis of the pressure of the ink supplied from the ink pack under pressure;

wherein the ink pressure corresponding to the ink-end point detected by the ink-end sensor is set to a first pressure that is the minimum pressure near an outlet of the ink cartridge at which the recording head can print an image of predetermined quality; and the determining unit permits starting of a printing or cleaning operation in response to a command issued before the ink-end sensor detects the ink-end point and prohibits starting of a printing or cleaning operation in response to a command issued after the ink-end sensor has detected the ink-end point.

2. The printing apparatus according to claim 1, wherein the ink channel includes a pressure-reducing valve upstream of the recording head; and the first pressure is calculated from the maximum pressure loss between the outlet of the ink cartridge and the center of the pressure-reducing valve in printing and the water head difference between the outlet of the ink cartridge and the center of the pressure-reducing valve.

3. The printing apparatus according to claim 1, wherein the first pressure is higher than lower limit of a second pressure near the outlet of the ink cartridge below which a meniscus collapses in the recording head; and the amount of ink that can be supplied from the ink cartridge while the ink pressure changes from the first pressure to the lower limit of second pressure is greater than or equal to the amount of ink consumed in cleaning.

4. The printing apparatus according to claim 3, wherein the second pressure is calculated from the water down difference of menisci of a nozzle of the recording head, the maximum pressure loss between the outlet of the ink cartridge and the recording head in printing, and the water head difference between the outlet of the ink cartridge and an outlet of the recording head.

5. The printing apparatus according to claim 1, wherein the ink cartridge includes an ink-level detecting unit including:

an ink-detecting chamber including an ink inlet, an ink outlet, a flexible diaphragm that is displaced in response to the ink pressure between the ink inlet and the ink outlet, and a detecting-section mounting surface facing the diaphragm, the volume of the ink-detecting chamber varying with the ink pressure;

a moving member disposed in the ink-detecting chamber so as to move together with the diaphragm; and a detecting section disposed on the detecting-section mounting surface and including the ink-end sensor and a detecting space portion communicating with the ink-detecting chamber, the ink-end sensor being a piezoelectric sensor that applies a vibration to the detecting space portion and detects a waveform of residual vibration following the vibration.

6. The printing apparatus according to claim 5, wherein the ink-end sensor detects the amplitude or frequency of the waveform of residual vibration on the basis of the distance between the ink-end sensor and the moving member.

* * * * *